United States Patent [19]

Morinaga et al.

[11] Patent Number: 4,769,900

[45] Date of Patent: Sep. 13, 1988

[54] METHOD OF MAKING A CHIP COIL

[75] Inventors: Tetsuya Morinaga, Fukui; Toshimi Kaneko, Sabae; Kazuya Nishimura, Yokaichi; Yukio Hata, Fukui, all of Japan

[73] Assignee: Murata Manufacturing Co., Ltd., Japan

[21] Appl. No.: 83,930

[22] Filed: Aug. 5, 1987

Related U.S. Application Data

[62] Division of Ser. No. 870,225, Jun. 3, 1986, abandoned.

[30] Foreign Application Priority Data

Jun. 5, 1985 [JP] Japan ..... 60-123137

[51] Int. Cl.[4] ..... H01F 41/02; H01F 27/26

[52] U.S. Cl. ..... 29/606; 29/608; 336/83; 336/192; 336/212; 336/233

[58] Field of Search ..... 336/83, 212, 233, 192, 336/221; 29/602 R, 605, 606, 607, 608

[56] References Cited

U.S. PATENT DOCUMENTS

| | | | |
|---|---|---|---|
| 2,594,915 | 4/1952 | Guillemant | 336/83 X |
| 2,966,704 | 1/1961 | O'Brian et al. | 336/83 X |
| 2,976,502 | 3/1961 | Hill | 336/83 |
| 3,201,729 | 8/1965 | Blanchi et al. | 336/83 |
| 3,255,512 | 6/1966 | Loehner et al. | 336/83 X |
| 3,325,760 | 6/1967 | Bernard | 336/83 |
| 3,381,251 | 4/1968 | Fuller | 336/83 |
| 3,750,069 | 7/1973 | Renskers | 336/83 |
| 3,833,872 | 9/1974 | Marcus et al. | 336/83 |

FOREIGN PATENT DOCUMENTS

| | | | |
|---|---|---|---|
| 1564556 | 7/1969 | Fed. Rep. of Germany | 336/83 |
| 662909 | 12/1951 | United Kingdom | 336/83 |

*Primary Examiner*—Thomas J. Kozma

*Attorney, Agent, or Firm*—Ostrolenk, Faber, Gerb & Soffen

[57] ABSTRACT

A chip coil which includes a bobbin, flange portions formed at opposite end portions of the bobbin, a wire wound around a barrel portion of the bobbin, and at least two counter-part blocks of magnetic particle-containing solid resin, disposed around the wound wire. The counter-part blocks of magnetic particle-containing solid resin are adapted to be fixed to each other into one combined unit.

10 Claims, 4 Drawing Sheets

METHOD OF MAKING A CHIP COIL

This is a division of U.S. patent application Ser. No. 870,225, filed June 3, 1986, now abandoned.

BACKGROUND OF THE INVENTION

The present invention generally relates to a coil and more particularly, to a chip coil of a wire wound type having a high magnetic shielding property and which may be manufactured with superior productivity. The invention also relates to a method of manufacturing such a chip coil.

Recently, as electronic appliances are increasingly being made in a thin and compact size, it has been a requirement to mount or load electronic components and parts onto an electronic appliance with a high density. Coils are not an exception with respect to such a requirement, and it has become necessary to form coils into chips and also to provide them with a magnetic shielding property, which is indispensable to the high density mounting.

A conventional chip coil provided with the magnetic shielding property is known to the art, having a construction as shown in FIG. 6. In FIG. 6, the known chip coil includes a bobbin B made of ferrite or the like and formed with flange portions Fa and Fb formed at opposite ends thereof, and a wire (not shown) wound around a barrel portion of said bobbin B. Over the wound wire referred to above, a layer R of resin mixed with magnetic particles, hereinafter "magnetic particle-containing resin," is formed, by coating the magnetic particle-containing resin in a liquid form onto the wire through employment of a dispenser or the like for subsequent curing or hardening. At the opposed end portions of the flange portion Fa of the bobbin B, there are respectively formed electrodes Ea and Eb, and one end of the wire wound around the barrel portion of the bobbin B is connected to the electrode Ea, while the other end thereof is connected to the electrode Eb.

In FIG. 7, there is shown another example of a conventional chip coil provided with a magnetic shielding property, with like parts in FIG. 6 being designated by like reference symbols. The known chip coil of FIG. 7 also includes a bobbin B, flange portions Fa and Fb formed at opposite ends of the bobbin B, and a wire W wound around the barrel portion of the bobbin B. Below the flange portion Fa, there are provided lead electrodes La and Lb, with one end of the wire W being electrically connected to the lead electrode La, and the other end thereof to the electrode Lb respectively. Over the bobbin B having the flange portions Fa and Fb and wound with the wire W, there is provided a covering layer RB of magnetic particle-containing resin formed by molding the resin with a metallic mold, with one end of each of the lead electrodes La and Lb being exposed externally.

However, the conventional chip coils described above have problems as follows.

Specifically, in the conventional chip coil as shown in FIG. 6, since the magnetic particle mixed resin in the liquid form must be coated through employment of a dispenser, etc., it is necessary to reduce the viscosity of the magnetic particle mixed resin in the liquid form by lowering the mixing ratio of the magnetic particles, and thus, there has been the disadvantage that the covering layer RB formed by curing such magnetic particle-containing resin is inferior in the magnetic shielding property. Moreover, if there is any scattering (variation) in the amount of coating by the magnetic particle-containing resin in the liquid form, this will result in the variation of the inductance and the quality factor Q in the final products. Furthermore, since complicated procedures are required for the coating of the magnetic particle-containing liquid form resin through employment of a dispenser or the like, and since a considerable time is taken to form the layer R by curing said resin, there is the disadvantage that the resultant chip coils tend to be high in cost and poor in productivity.

On the other hand, in the conventional chip coil as shown in FIG. 7, there are also the disadvantages that when the mixing ratio of the magnetic particles in the magnetic particle-containing liquid form resin is lowered, the magnetic shielding property of the layer RB undesirably becomes insufficient. On the other hand, if the mixing ratio thereof is made high, the viscosity of the resin becomes large, which also results in inconveniences, for example, the workability of the resin for molding of the covering layer RB by the metallic mold may be impaired or such molding may not be able to be effected in certain cases. Additionally, severe abrasion of the metallic mold by the magnetic particles tends to give rise to an increase in the production cost.

SUMMARY OF THE INVENTION

Accordingly, an essential object of the present invention is to provide an improved chip coil of a wound wire type which has a favorable magnetic shielding property, with substantial elimination of the disadvantages inherent in the conventional chip coils of this kind.

Another important object of the present invention is to provide a chip coil of the above described type which is simple in construction and stable in functioning, and can be readily manufactured at low cost with a favorable workability for improved productivity.

In accomplishing these and other objects, according to one preferred embodiment of the present invention, there is provided a chip coil which includes a bobbin, flange portions formed at opposite end portions of the bobbin, a wire wound around a barrel portion of said bobbin, and at least two counter-part blocks of magnetic particle-containing solid resin, disposed around the wound wire. The counter-part blocks of magnetic particle-containing solid resin are arranged to be fixed to each other into one combined unit so as to hold the barrel portion therebetween.

By the arrangement of the present invention as described above, an improved chip coil has been advantageously presented having a simple structure and a low cost.

BRIEF DESCRIPTION OF THE DRAWINGS

These and other objects and features of the present invention will become apparent from the following description of a preferred embodiment thereof with reference to the accompanying drawings, in which.

DETAILED DESCRIPTION OF THE INVENTION

Figure 1:
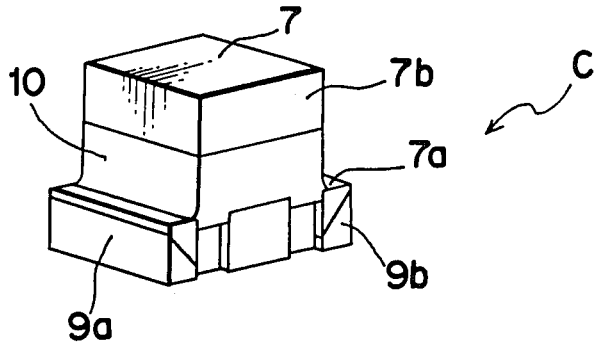
FIG. 1(A) is a perspective view of a chip coil according to one preferred embodiment of the present invention.
FIG. 1(B) is a side sectional view of the chip coil of FIG. 1(A)
Figure 1B:
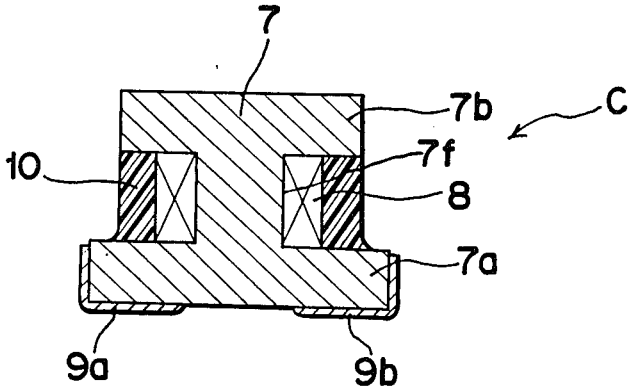

Before the description of the present invention proceeds, it is to be noted that like parts are designated by like reference numerals throughout the accompanying drawings.

Figure 2:
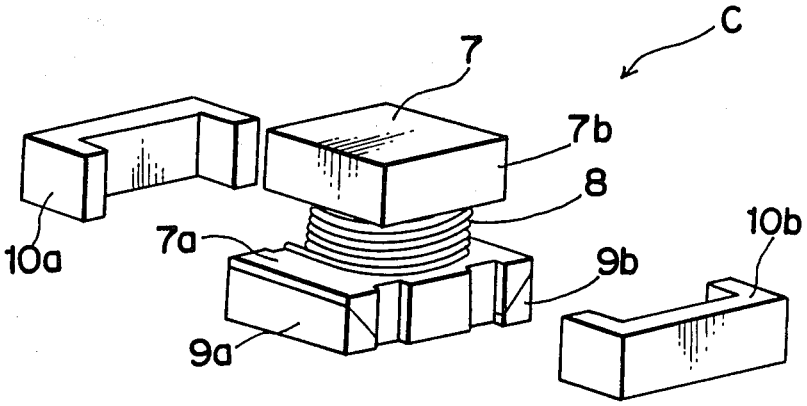
FIG. 2 is an exploded perspective view before assembling of the chip coil of FIG. 1(A), FIGS. 3(A) and 3(B) are perspective views showing modifications of counter-part blocks of magnetic particle-containing solid resin employed in the chip coil of FIG. 1(A)

Referring now to the drawings, there is shown in FIGS. 1(A) through 2, a chip coil C according to one preferred embodiment of the present invention.

The chip coil C generally includes a bobbin 7 made, for example, of ferrite or the like, flange portions *7a* and *7b* formed at opposite end portions of the bobbin 7, a wire 8 wound around a barrel portion *7f* of said bobbin 7 between said flange portions *7a* and *7b*, electrodes *9a* and *9b* respectively formed on opposed end portions of the flange portion *7a*, with one end of the wire 8 being electrically connected to the electrode *9a*, and the other end thereof to the electrode *9b*.

The chip coil C further includes a combined unit 10 of magnetic particle-containing solid resin which is disposed to surround the wire 8 wound around the barrel portion *7f* of the bobbin 7 in a position between said flange portions *7a* and *7b*, and formed by combining two preliminarily molded U-shaped counter-part blocks *10a* and *10b* of the magnetic particle-containing solid resin by fixing them together to form one combined unit 10. This combined unit 10 of the magnetic particle-containing solid resin adheres also to the flange portions *7a* and *7b* of the bobbin 7 and at least part of the wound portion of said wire 8. The counter-part blocks *10a* and *10b* of the magnetic particle-containing solid resin are each formed in the following manner. A composite material in a semi-hardened state is prepared, for example, by mixing Mn-Zn magnetic particles, Ni-Zn magnetic particles or the like into epoxy resin, silicone resin, etc. This material is then preliminarily molded, for example, by compression molding or the like, into a shape which allows the contact thereof with the peripheral face of the wire 8 wound around the barrel portion *7f* of the bobbin 7. In practical applications, the magnetic particles to be mixed should preferably have particle diameters in the range of 1 to 250 μm, and the mixing ratio of the magnetic particles to resin should practically be 100–1900 parts of magnetic particles to 100 parts of resin. The counter-part blocks *10a* and *10b* of the magnetic particle-containing solid resin are then heated and brought into pressure contact with the wound portion of the wire 8 in a semi-molten state, although maintaining the shape thereof, and after subsequent curing or hardening, formed into the combined unit 10 referred to above.

It should be noted here that the concept of the present invention is not limited in its application to the foregoing embodiment alone, but may be modified in various ways within the scope of the invention. For example, the number and the configuration of the counter-part blocks *10a* and *10b* may be altered as desired, and are not limited to the two U-shaped blocks as in the above embodiment.

Figure 3A:
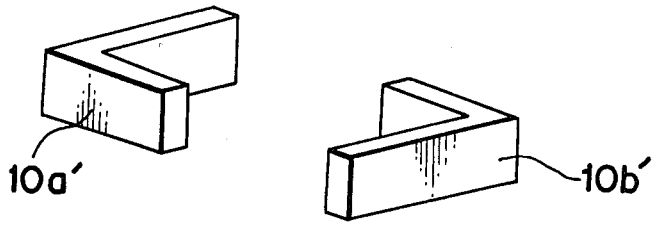
Figure 3B:
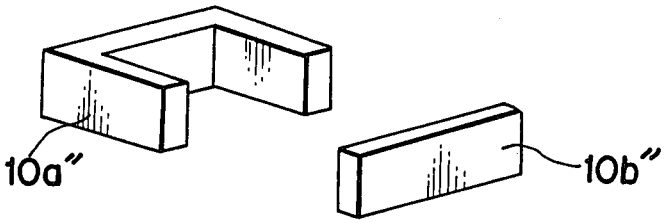

By way of example, the counter-part blocks *10a* and *10b* may be replaced with a pair of blocks *10a'* and *10b'* each having an L-shaped cross section as shown in FIG. 3(A), or replaced with a block *10a''* with a U-shaped cross section and a flat plate-like block *10b''* having an I-shaped cross section which may be fitted onto an open edge of said U-shaped block *10a''*, either of which would surround the barrel portion *7f* of the bobbin 7 in a similar manner as in the counter-part blocks *10a* and *10b*.

It should also be noted here that the resin and magnetic particles constituting the counter-part blocks of magnetic particle-containing solid resin are not limited to the epoxy resin or silicon resin, or to Mn-Zn magnetic particles or Ni-Zn magnetic particles, as in the foregoing embodiment, but may be suitably selected as desired so far as they serve the purpose of the present invention. Similarly, the resin my be of a thermo-setting nature or a thermo-plastic nature.

As is seen from the foregoing description, the chip coil according to the present invention includes at least two counter-part blocks of the magnetic particle-containing solid resin, which are disposed to surround the wire wound around the barrel portion of the bobbin, with the counter-part blocks being fixedly connected to each other into one combined unit. Accordingly, unlike in the conventional chip coils employing the magnetic particle-containing liquid form resin as explained earlier with reference to FIGS. 6 and 7, in the chip coil of the present invention, there is no such limitation that the mixing ratio of the magnetic particles must be made low in the magnetic particle-containing solid type resin. Therefore, since a high mixing ratio of the magnetic particles is available, a chip coil having the combined unit of the magnetic particle-containing solid resin with a sufficient magnetic shielding property may be advantageously obtained. Furthermore, the chip coil according to the present invention is free from the problem of the conventional chip of FIG. 6, that variations in the inductance and quality factor Q are brought about due to variations in the coating amount of the magnetic particle-containing liquid form resin.

Figure 4:
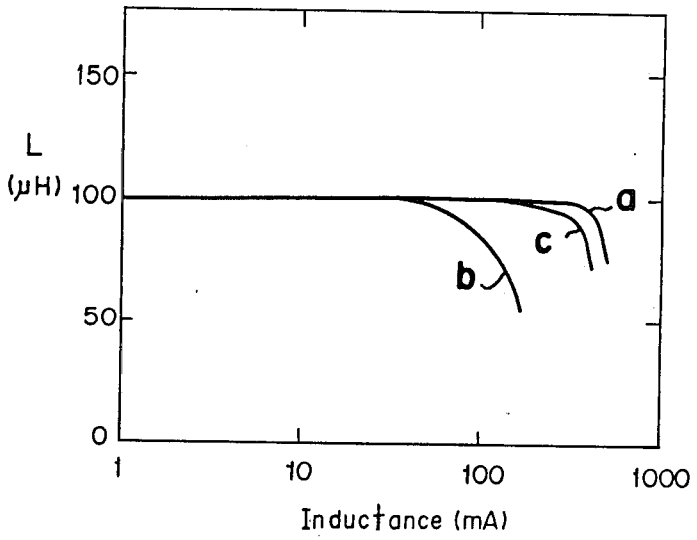
FIG. 4 is a graph showing a comparison in DC-inductance characteristics between the chip coil of the present invention and the conventional chip coil.
Figure 6:
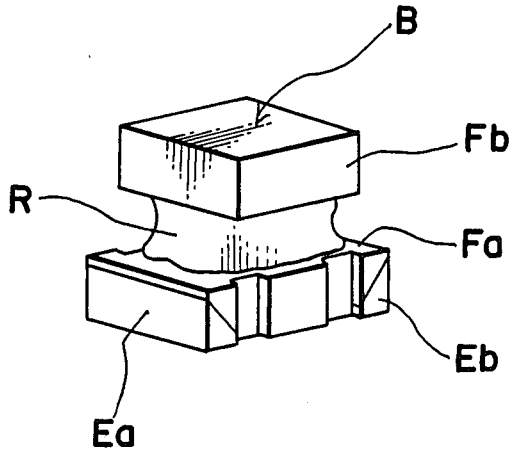
Fig. 6 PRIOR ART
FIG. 6 is a perspective view showing one example of a conventional chip coil (already referred to)
Figure 7:
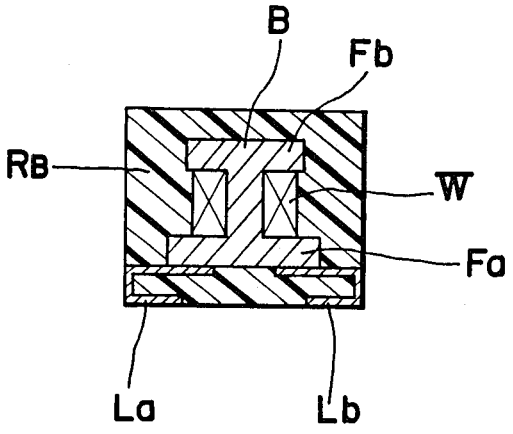
Fig. 7 PRIOR ART
FIG. 7 is a side sectional view showing another example of a conventional chip coil (already referred to).

In FIG. 4, there is shown a graphical diagram representing a comparison of the DC-inductance characteristics of a chip coil not supplied with the magnetic shielding (represented by a line a) the chip coil coated with the conventional magnetic particle containing liquid form resin as shown in FIG. 6 (represented by a line b), and a chip coil of the present invention (represented by a line c). From FIG. 4, it is seen that the chip coil of the present invention has less deterioration in the allowable current than the conventional chip coil.

Figure 5:
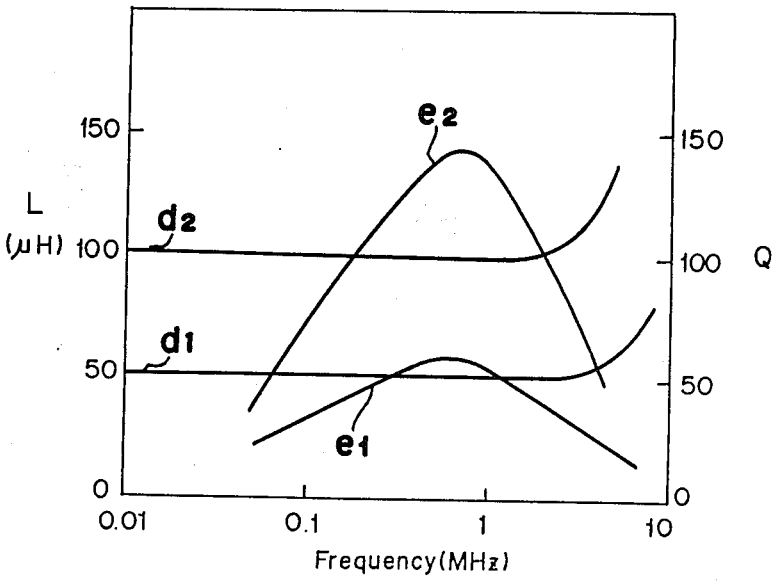
FIG. 5 is a graph showing a comparison of values of inductance and quality factor Q before and after magnetic shielding of the chip coil according to the present invention.

The graphical diagram in FIG. 5 shows a comparison of the values of inductance and quality factor Q before and after magnetic shielding of the chip coil of the present invention by the combined unit 10 of the magnetic particle-containing solid resin. In FIG. 5, the inductance value and value of quality factor Q before the magnetic shielding are represented by d1 and e1, while those after the magnetic shielding are denoted by d2 and e2 respectively. From the diagram of FIG. 5, it is observed that, in the chip coil of the present invention, the values of both inductance and quality factor Q are increased by more than two times.

As is clear from the foregoing description, according to the present invention, since it is not required to effect troublesome and time-taking operations for coating the magnetic particle-containing liquid form resin by a dispenser or the like, or to mold such resin by a metallic mold as in the conventional chip coil, without necessity to employ such expensive appliances as the dispenser, metallic mold for molding, etc., the chip coil of the present invention may be manufactured at low cost, with a high productivity.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A method of shielding a chip coil, said chip coil comprising a bobbin, flanges formed at opposite ends of said bobbin, and a wire wound around said bobbin between said flanges, the method comprising the steps of:

(a) forming at least two counterpart blocks comprising magnetic particle-containing solid resin;

(b) disposing said blocks about said bobbin, said blocks engaging each other so as to substantially surround said wire; and (c) fixing said blocks to each other to form a combined unit;

wherein each of said counterpart blocks of magnetic particle-containing solid resin is formed by mixing magnetic particles selected from the group consisting of Mn-Zn and Ni-Zn magnetic particles into a resin selected from the group consisting of epoxy resin and silicone resin, in a mixing ratio of substantially 100 to 1900 parts of the magnetic particles to 100 parts of the resin, to form a composite material; and wherein said composite material is prepared in a semi-hardened state and then preliminarily molded into a block having a shape which permits said block to engage the flanges and the wire wound on the bobbin.

2. A method as claimed in claim 1, further comprising the step of forming a pair of electrodes on opposite edge portions of one of said flanges, said wire having two ends, and each of said ends of said wire being connected to a respective one of said electrodes.

3. A method as claimed in claim 1, wherein the magnetic particles have particle diameters in the range of 1 to 250 microns.

4. A method as claimed in claim 1, wherein each of said counter-part blocks of magnetic particle-containing solid resin has a U-shaped cross section so as to substantially completely surround said wire, when combined into a combined unit, with the extreme ends of the U-shaped blocks in engagement with each other.

5. A method as claimed in claim 1, wherein each of said counter-part blocks of magnetic particle-containing solid resin has an L-shaped cross section so as to substantially completely surround said wire, when combined into a combined unit, with the extreme ends of the L-shaped blocks in engagement with each other.

6. A method as claimed in claim 1, wherein a first one of said counter-part blocks of magnetic particle-containing solid resin has a U-shaped cross section, and a second one of said counter-part blocks has a flat plate-like shape with an I-shaped cross section configured and dimensioned so that said first and second counter-part blocks substantially completely surround the wire, when combined into a combined unit, with the extreme ends of the U-shaped block in engagement with the extreme ends of the I-shaped block.

7. A method as claimed in claim 1, wherein said blocks are configured and dimensioned so as to engage said flanges, and thereby substantially completely surround said wire, when said blocks are formed into a combined unit.

8. A method as claimed in claim 7, wherein said combined unit is adhered to said flanges.

9. A method as claimed in claim 8, wherein said combined unit is adhered to said wire.

10. A method as claimed in claim 1, wherein said blocks are then heated, brought while hot into contact with each other as well as with the wire and flanges, and then hardened to form said combined unit.

* * * * *